Figure 1:
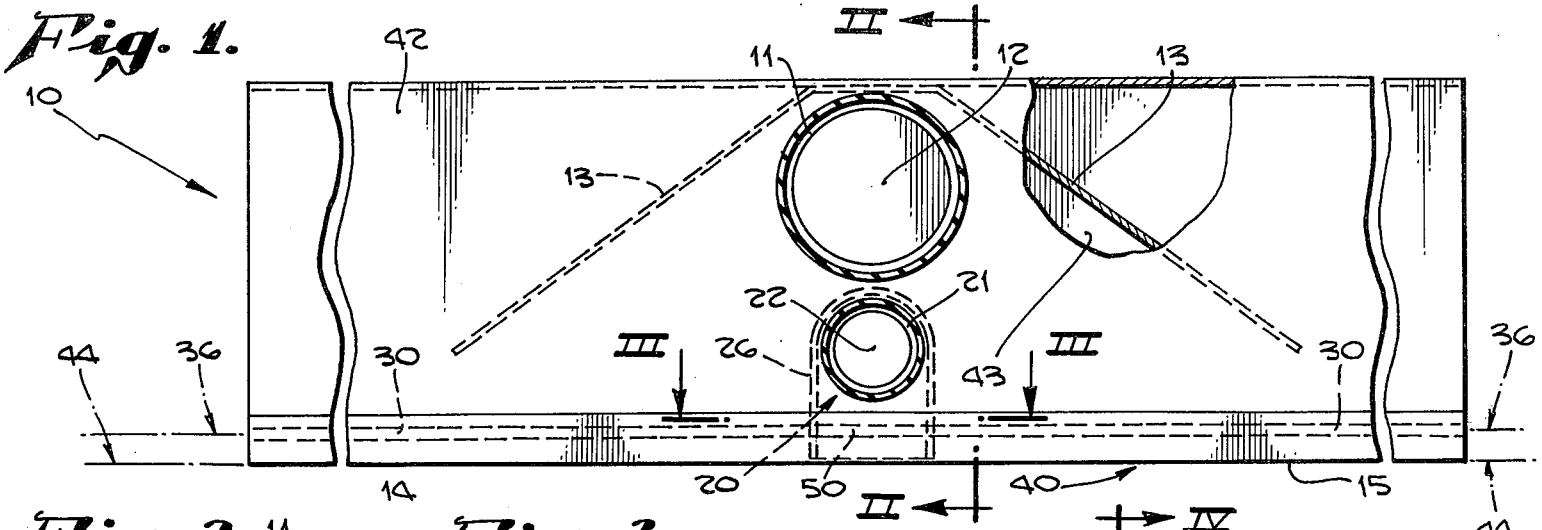

JET PAIR WEIR GATE

BACKGROUND OF THE INVENTION

The present invention relates generally to air diffuser outlets compatible with suspended ceiling air conditioning systems, and, more particularly, to the provision of a dual flow nested plenum chamber construction and improved weir control surfaces using jet pair weir gates to improve the effectiveness and controllability of air diffusion outlets installed in suspended ceilings.

The improved diffuser outlet disclosed herein incorporates the same construction and operating advantages as conventional diffuser outlets such as those disclosed in U.S. Pat. No. 3,411,425 entitled "AIR DIFFUSION OUTLET WITH LATERALLY ADJUSTABLE WEIR CONTROL" issued Nov. 19, 1968 to the common inventor of this application, namely, construction that permits mounting of the outlet flush with the surface of a suspended ceiling (suspended from the undersurface of the permanent floor or roof of a building, herein referred to as the soffit), placement adjacent to light panels or fixtures as well as points distant therefrom, and of various sizes that are readily adjusted for cooperation with air supply ducts of different sizes and necks, and providing means for controlling the direction of airflow therefrom. U.S. Pat. No. 3,411,425 particularly provides for the use of an adjustable weir that is comprised of a pair of U-shaped channel members that are in an opposed, nested relationship such that they can laterally expand and contact to selectively and variably obstruct the opening of a diffuser outlet to control the volume and direction of a diffused airflow. This construction is compatible with a single plenum chamber and can utilize the horizontal flange of a suspended ceiling T-bar to direct and diffuse the airflow.

While the various diffusers disclosed in said patent provide a type of diffused airflow that works well for many applications, there are some instances where a more focused airflow, as well as two types of airflow from a single diffuser, are highly desirable. This is particularly true for air conditioning systems that must operate in a non-homogeneous, more hostile environment. One such environment is the room that contains large glass windows exposed to either a significantly hotter or significantly colder external environment. These windows tend to be highly conductive and, by convection due to the resulting temperature gradient, can rapidly alter the temperature and character of a diffusive airflow in their vicinity, thus preventing said room from attaining a uniform, comfortable temperature and airflow without the use of an excessive number of diffuser outlets or the utilization of a large and costly volume of conditioned air.

SUMMARY OF THE INVENTION

It is therefore a primary object of the present invention to disclose and provide a diffuser outlet control means that will provide a highly focused jet flow of conditioned air so that conditioned air will be more efficiently delivered to a point distant from the diffuser outlet. For a room exposed to a cold winter environment, for example, the improved control surfaces known herein as a jet pair weir gate can deliver a flow of normally heated or super-heated air in a focused column from a diffuser located in a suspended ceiling near a window to a location near the floor thus minimizing heat loss by convection and conduction through the adjacent, externally exposed window. This allows said airflow to then be diffused at the floor and convectively rise near the window to both insulate the room occupants from and minimize the cold pockets in the vicinity of said window.

The preceding and following discussions assume the delivery of heated air to a room that is in a cold external environment, but these discussions are equally applicable to other environments including the delivery of cooled air to a room in a very hot external environment and the delivery of humidified, dehumidified, filtered, or scrubbed air to a room situated in a surrounding dry, wet, odorous, or otherwise contaminated environment, respectively.

It is also an object of the present invention to disclose and provide a plurality of separately adjustable control surface portions within an outlet for providing multiple modes of airflow from said single outlet. For the exemplar room environment previously described, an elongated diffuser outlet could be mounted along the edge of the suspended ceiling adjacent the externally exposed window that would provide along a substantial portion of its length a diffused planar sheet or veil of air flowing across said window and further, a central focused jet flow of air for delivery to the floor near the foot of the window with a minimum degree of convective and conductive heat exchange with the window surface.

It is a further object of the invention that the flows generated by these two outlet portions may have different characteristics in that one may be a constant volume flow, particularly the jet flow, and the other may be a variable volume flow. The flows may also differ in their temperature, such as the jet flow air being super-heated. Accordingly, the further object of the present invention is to provide for these different flows within a single outlet resulting in both economy and ease of construction and installation of diffuser system by utilizing nested plenum chambers within a diffuser construction.

Generally stated, the present invention is a combined plenum and air diffusion outlet assembly that incorporates improved subassemblies of nested plenum chambers and jet pair weir gates as herein described.

More particularly, a jet pair weir gate is provided that is comprised of two pairs of nested jet weir members. Each jet weir member is a generally U-shaped channel consisting of an imperforate web portion and two flange portions. Each pair of jet weir members is mounted in an opposed and nested relation so that each pair is both laterally expansible and laterally movable across the outlet width.

The two pair of jet weir members are mounted in said outlet such that the medial flange of each pair is depending and said flange is further provided with an extended length serving as a control surface. The depending flanges, together act as a nozzle to focus a jet flow of air therebetween.

This configuration of jet pair weir gate allows a number of different modes of flow to be selected for the jet portion of the air diffuser outlet. These flow configurations include a laminar vertical flow, a vertical jet flow, an angled diffused flow that can be angled in any direction, an angled diffused jet flow that can also be angled in any direction, and a fully closed or blocked flow.

Nested plenum chambers provide two different types of flow emanating from a single diffusion outlet assembly while maintaining the ease of construction, installation, and aesthetic value of a single outlet assembly.

diffused airflow. In the fourth mode, the members are relatively collapsed and are generally centered between the outlet walls 41 and 42 such that the airflow is peripheral to both ends of the pair of members, medial the respective outlet walls 41 and 42, and past the outlet flanges 45 and 46 resulting in a substantially non-angled diffusive airflow.

Figure 3:
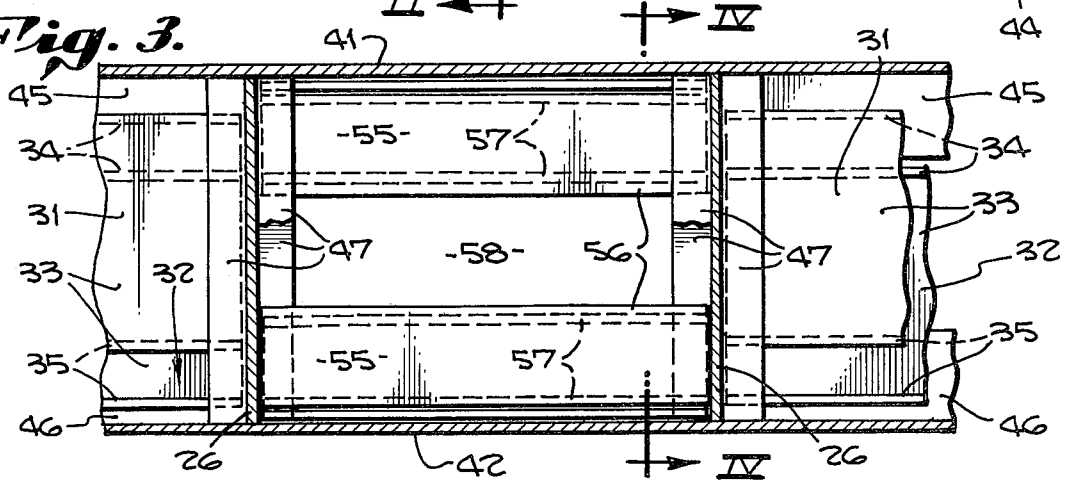
Figure 2:
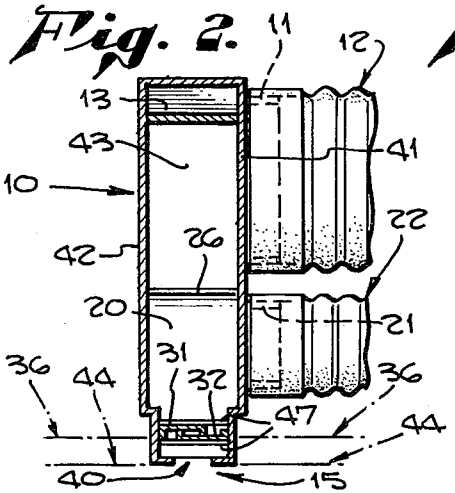
Figure 4:
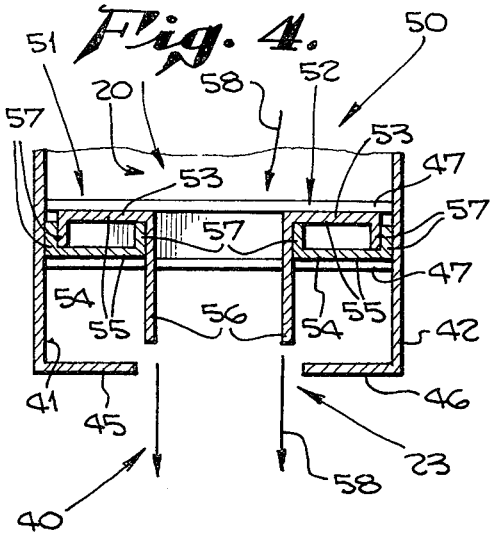

FIGS. 1–11, particularly FIGS. 3 and 4, show a preferred embodiment of a jet pair weir gate 50. The jet pair weir gate 50 is comprised of two pairs 51 and 52 of nested jet weir members 53 and 54. Each jet weir member is a generally U-shaped channel consisting of an imperforate web portion 55 and two flange portions 56 and 57. The jet weir members 53 and 54 of each pair are mounted in an opposed and nested relation as shown in FIG. 4; the two pairs 51 and 52 of jet weir members are mounted with mounting means 47 such that they are in a laterally spaced relationship within said airflow path 43 and lie generally in a second plane 36 which is spaced above and substantially parallel to said first plane 44. The members of each pair are further mounted in such a manner that the member having depending flanges 53 of the first pair 51 is mounted proximal the member having depending flanges 53 of the second pair 52 such that the medial flanges 56 of each pair depend toward the outlet 40 defining a jet airflow path 58.

In one considered improved version, the medial depending flanges 56 have an elongated length such that they substantially depend to the plane 44 of the outlet flanges 45 and 46. This extended length provides a control surface to increasingly focus the airflow 58 flowing therebetween. The extended length flat surfaces of the depending flanges 56 tend to create a laminar, more highly focused jet airflow.

The members 53 and 54 of each pair 51 and 52 of the jet pair weir gate 50 are together laterally movable in said second plane 36 relative to the other pair such that the distance between the depending flanges 56 is variable. The members of each pair are also laterally movable in said second plane 36 relative to one another such that together the members of a pair 53 and 54 are laterally expansible thereby increasing or decreasing obstruction to the airflow path 43. Finally, each pair 51 and 52 is laterally movable in said second plane 36 relative to the outlet walls 41 and 42 such that they may assume various positions within the airflow path 43, variably obstructing both the jet airflow path 58 and the diffusive airflow paths 59 and 60 which are medial of the outlet walls 41 and 42 and peripheral the respective adjacent pair 51 or 52. These selective movements combine to variably adjust the flow through the diffusive airflow paths 59 and 60 and the jet airflow path 58 of the outlet 23 and are thereby capable of generating a number of modes of flow.

Optimally, the combined widths of the web portions 33 of each member 53 and 54 of each pair 51 and 52 should be wide enough to completely close the airflow path 43 when the pairs are in a fully expanded condition and narrow enough to allow as substantial volume of airflow when the pairs 51 and 52 are in a fully collapsed condition. Accordingly, the width of said web portions 33 should be at least one-fourth the width between the opposing spaced outlet walls 41 and 42 and the width of each pair of gate 51 and 52 should be at least one-half the width between said outlet walls 41 and 42.

FIG. 4 shows a first mode of flow wherein the members of each pair are in a fully collapsed condition and each pair is positioned adjacent to the respective outlet wall 41 and 42 such that all portions of the airflow path 43 are obstructed except the jet airflow path 58. In this configuration, when coupled to a constant volume air source, a relatively laminar moderate velocity airflow descends as a vertical column into the room.

Figure 5:
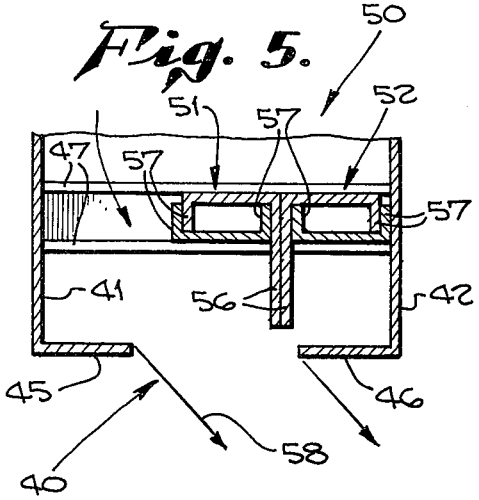

FIG. 5 shows both pairs 51 and 52 in a fully collapsed condition and positioned fully to the right such that the airflow path 43 is obstructed except for flow around the left end of the two pairs and past outlet flange 45, diffusive airflow path 59. This mode of flow generates a relatively turbulent or diffused airflow that is highly angled to flow to the right, close to the ceiling.

Figure 6:
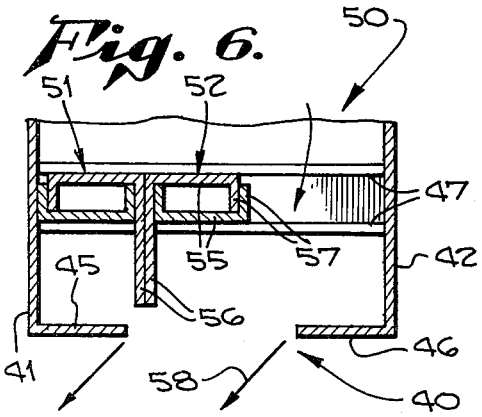

FIG. 6 shows both pairs 51 and 52 in a fully collapsed condition and in this mode, positioned fully to the left such that the airflow path 43 is obstructed except for flow around the right end of the two pairs and past the opposite outlet flange 46, diffusive airflow path 60. This mode of flow generates a relatively turbulent or diffused airflow that is highly angled to flow to the left, close to the ceiling.

Figure 7:
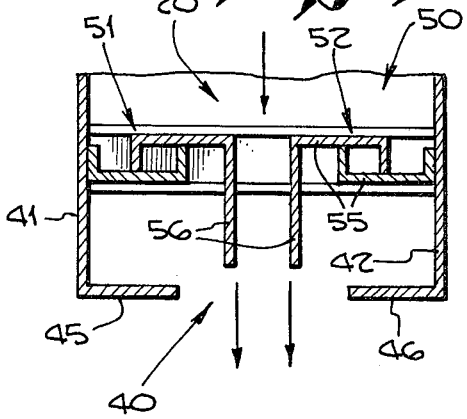

FIG. 7 shows both pairs 51 and 52 only partially collapsed, obstructing a substantial portion of the outlet 40. Each pair is positioned adjacent to the respective outlet wall 41 and 42 such that all portions of the airflow path 43 are obstructed except the jet airflow path 58. This configuration, with a more narrow jet airflow path 58, produces a more highly focused and higher velocity vertically descending jet airflow.

Figure 8:
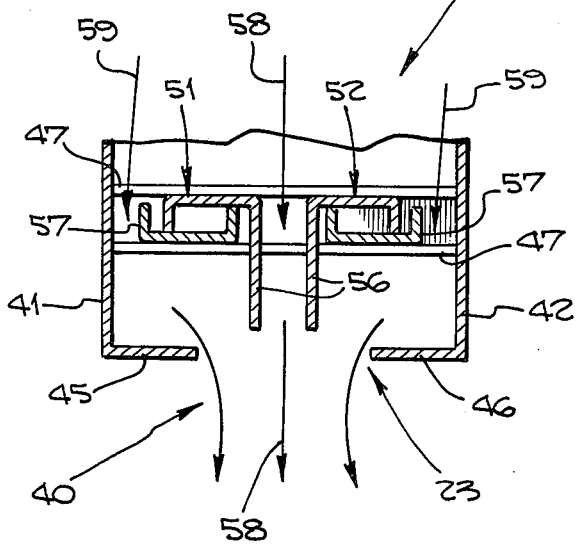

In FIG. 8, both pairs 51 and 52 are only partially collapsed, obstructing a substantial portion of the outlet 40. Further, the pair are positioned such that air may flow peripheral the left pair 51, medial the respective outlet wall 41 and past the respective outlet flange 45, diffusive airflow path 59; peripheral the right pair 52, medial the respective outlet wall 42 and past the respective outlet flange 46, diffusive airflow path 58; and between the medial depending flanges 56, jet airflow path 58. This mode produces a vertically descending high velocity airflow that interacts with the vortices produced by the outlet flanges 45 and 46 to produce a more turbulent jet airflow that diffuses at a point distant from the outlet.

Figure 9:
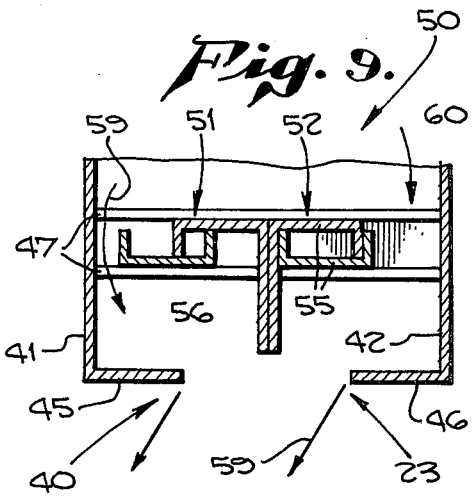

FIG. 9 shows the left pair 51 in an only partically collapsed condition and the right pair 52 in a fully collapsed condition, together obstructing a substantial portion of the outlet 40. The pairs are positioned such that the medial depending flanges 56 are adjacent one another and obstructing jet airflow path 58. Further, the total airflow path obstructing surfaces of the jet pair weir gate 50 are positioned left of center, closer to the left outlet wall 41 than the right outlet wall 42, with the depending flanges 56 substantially centered to produce a high velocity diffusive airflow. In this mode, the airflow path 43 is obstructed except for flow around the right end of the right pair 52, medial the respective outlet wall 42 and past the respective outlet flange 46, diffusive airflow path 60; and a lesser flow around the left end of the pair 51, medial the respective outlet wall 41 and past the respective outlet flange 45, diffusive airflow path 59. The depending flanges 56 and the outlet flange 46 combine to produce a narrowed airflow path 60 which acts as a nozzle to impart an increase in velocity and turbulance to the resulting diffusive airflow therebetween. Diffusive airflow path 59 further biases said resulting airflow by imparting vortices that increase the turbulance, diffusing said resulting airflow. This airflow path 59 also biases the direction of the resulting airflow to produce a less highly angled flow, angled left of vertical.

Figure 10:
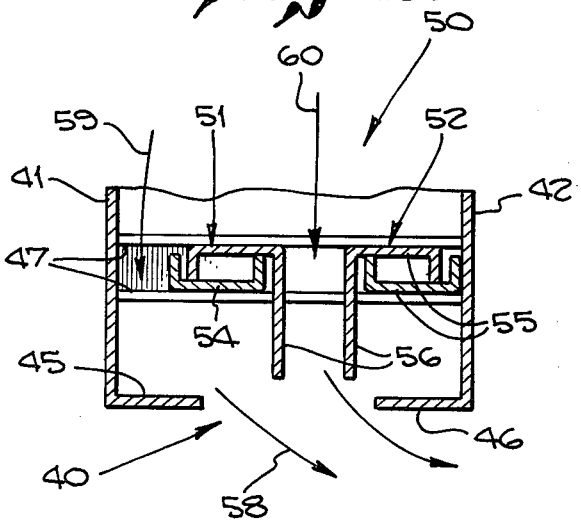

In FIG. 10, the left pair 51 is only partially collapsed and the right pair 52 is fully collapsed to obstruct a substantial portion of the outlet 40. The right pair 52 is positioned adjacent the respective outlet wall 42 to fully obstruct the diffusive airflow path 60. The left pair 51 is positioned such that air may flow peripheral the left pair 51, medial the respective outlet wall 41 and past the respective flange 45, diffusive airflow path 59; and between the medial flanges 56 of the pairs 51 and 52, jet airflow path 58. Diffusive airflow path 59 imparts biasing vortices upon jet airflow path 58 to bias said jet airflow to decend at an angle right of vertical. Said vortices increase the turbulance of the resulting airflow to diffuse said airflow at a point distant from the outlet 40.

Figure 11:
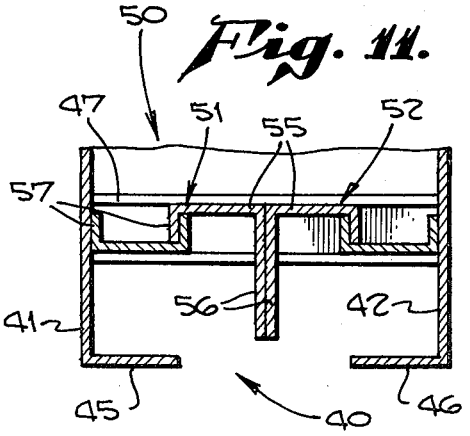

FIG. 11 shows both pairs 51 and 52 in a fully expanded condition such that they fully obstruct the airflow path 43. This corresponds with the fully closed mode of operation.

The modes just described and a continuum of modes therebetween demonstrate the versatility of an easily constructed and installed air diffusion assembly and its capability to condition the air of a room located in a hostile environment much more effectively than prior designs. Having thus described a preferred exemplary embodiment of a combined plenum and air diffusion outlet assembly that incorporates improved subassemblies of nested plenum chambers and jet pair weir gates in accordance with the present invention, it should be apparent to those skilled in the art that various additional alternative embodiments, adaptations and modifications can be made within the scope and spirit of the present invention which is defined by the following claims.

I claim:

1. In an air diffuser assembly having a diffuser outlet below spaced walls defining an air flow path from a source to said outlet; said outlet being defined in part by the medial edge of outlet flanges extending horizontally inward from an opposing pair of said spaced walls; the width of said outlet, defined as the distance between the medial edges of the pair of said outlet flanges, being generally twice the width of one of said outlet flanges; said outlet and outlet flanges defining a first plane substantially coinciding with the plane of a suspended ceiling mounting said air diffuser assembly; said assembly including at least one diffusion weir assembly portion;

said diffusion weir assembly portion including a pair of nested elongated diffusion weir members; each of said members being a generally U-shaped imperforate channel consisting of a web portion and two flange portions; said web portion having a width greater than that of said outlet; means for mounting said weir members in opposed and nested relation in a second plane spaced above and generally parallel to said first plane; said members being together laterally moveable in said second plane to cooperate with said outlet flanges to control the direction of airflow from said outlet and being moveable relative to one another to vary the combined width of the pair of weir members and thus control the amount of airflow from said outlet, the improvement comprising:

a jet weir assembly portion defining a second air flow path from a second, constant volume source to said outlet; including two pairs of nested elongated jet weir members of shorter length than said diffusion weir members; each of said jet weir members being a generally U-shaped imperforate channel consisting of a web portion and two flange portions; said web portion having a width greater than half that of said outlet; mounting means for mounting said jet weir members in laterally spaced pairs in a third plane spaced above and substantially parallel to said first plane such that each member in a pair is in an opposed and nested relation and such that the inverted member of each pair is mounted proximal the inverted member of the other pair such that the medial flange of each pair is depending toward said outlet; the medial flange of each pair having an extended length such that it substantially reaches said first plane and such that the extended length flanges, together, define control surfaces that act as a nozzle, thereby creating a jet flow through said outlet; said members of each pair being together laterally moveable in said third plane relative to the other pair and each member of a pair being laterally moveable relative to the other member of the pair and the two pairs, together, being laterally moveable relative to the outlet to cooperate with said outlet flanges to control the jet quality, volume, velocity, and direction of airflow from said outlet.

* * * * *

United States Patent [19]

Bolton et al.

[11] 4,316,408

[45] Feb. 23, 1982

[54] DAMPER ASSEMBLY FOR USE WITH AN AIR CONDITIONING SYSTEM

[75] Inventors: Theodore S. Bolton, Liverpool; Richard D. Lang, Chittenango, both of N.Y.

[73] Assignee: Carrier Corporation, Syracuse, N.Y.

[21] Appl. No.: 151,036

[22] Filed: May 19, 1980

[51] Int. Cl.[3] ..... F24F 13/00

[52] U.S. Cl. ..... 98/41 R; 251/297; 251/298

[58] Field of Search ..... 98/39, 40 R, 40 C, 40 V, 98/40 VM, 40 N, 41 R, 102, 106, 114; 251/297, 298; 126/295

[56] References Cited

U.S. PATENT DOCUMENTS

| | | | |
|---|---|---|---|
| Re. 12,004 | 6/1902 | Auer | 98/108 |
| 145,989 | 12/1873 | Cook | 126/295 |
| 1,377,168 | 5/1921 | Awe | 251/297 X |
| 2,516,871 | 8/1950 | Haugen | 98/40 C |
| 2,656,156 | 10/1953 | Wilcox | 98/40 C |
| 2,727,455 | 12/1955 | Miller et al. | 98/40 C |
| 3,084,610 | 4/1963 | Garrison et al. | 98/40 C |
| 3,389,649 | 6/1968 | Lärkfeldt | 98/41 R |
| 3,717,082 | 2/1973 | Jung | 98/114 |

FOREIGN PATENT DOCUMENTS

| | | | |
|---|---|---|---|
| 2545884 | 4/1977 | Fed. Rep. of Germany | 98/40 C |
| 497471 | 9/1954 | Italy | 98/40 C |

*Primary Examiner*—William E. Wayner
*Assistant Examiner*—Harold Joyce
*Attorney, Agent, or Firm*—J. Raymond Curtin; Robert P. Hayter

[57] ABSTRACT

Apparatus for regulating air flow through a housing is disclosed. A damper assembly including a bowed leaf spring is provided such that the leaf spring contacts the edge of the damper to secure the damper in position. The combination arrangement is utilized to either regulate the flow of air being discharged from the unit or to divert air between multiple outlets in the housing.

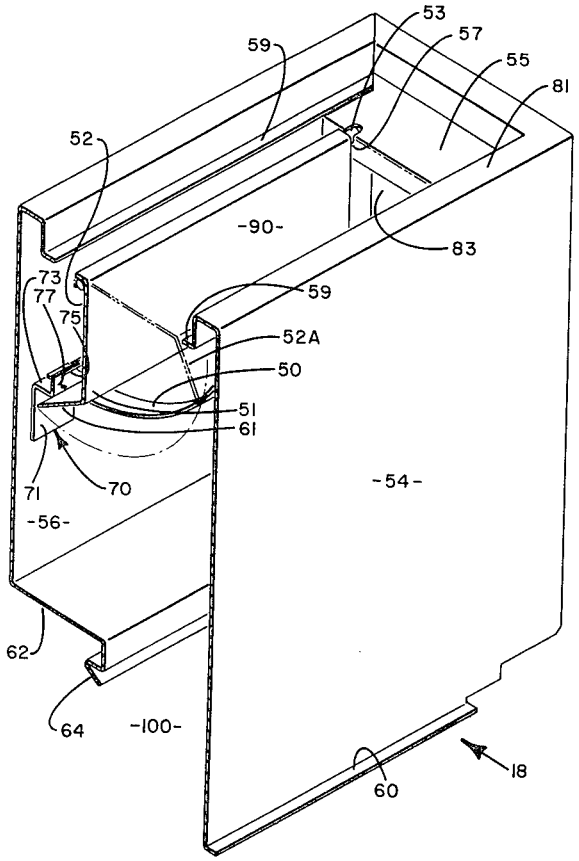

9 Claims, 4 Drawing Figures